United States Patent [19]

Woodrow

[11] 4,074,553

[45] Feb. 21, 1978

[54] LAYING PIPE

[75] Inventor: Harold E. Woodrow, Worcester, Mass.

[73] Assignee: Morgan Construction Company, Worcester, Mass.

[21] Appl. No.: 756,361

[22] Filed: Jan. 3, 1977

[51] Int. Cl.[2] ..... B21D 11/00

[52] U.S. Cl. ..... 72/66; 138/120; 138/155; 193/2 R; 226/97

[58] Field of Search ..... 226/97; 302/64; 193/38, 193/2 R; 285/16, 55; 138/120, 155; 72/66

[56] References Cited

U.S. PATENT DOCUMENTS

| | | | |
|---|---|---|---|
| 300,990 | 6/1884 | Mahaffey | 302/64 |
| 3,469,429 | 9/1969 | Dopper et al. | 72/66 X |
| 3,857,590 | 12/1974 | Meeker | 138/12 X |

FOREIGN PATENT DOCUMENTS 4,653 of 1899 United Kingdom.

*Primary Examiner*—Leon Gilden

*Attorney, Agent, or Firm*—Thompson, Birch, Gauthier & Samuels

[57] ABSTRACT

In a rolling mill, a rotatable laying pipe having at least one curved tubular pipe section with entry and exit ends. Replaceable tubular liner members are arranged in end-to-end relationship in each pipe section. Retainers are provided at the entry and exit ends of the pipe sections for retaining the liners in place during operation of the laying head.

5 Claims, 5 Drawing Figures

LAYING PIPE

DESCRIPTION OF THE INVENTION

This invention relates generally to laying heads in rolling mills, and is concerned in particular with an improved laying pipe for use therewith.

In modern rod mill installations, laying pipes operate at very high rotational speeds. For example, in a mill producing 0.312 inch diameter rod at a finishing speed of 5000 feet per minute, the laying pipe of the laying head must rotate at 640 R.P.M. in order to form the product into a helix with ring diameter of approximately 30 inches. Rotational speeds of this magnitude produce proportionally high centrifugal stresses. Consequently, selection of the laying pipe material is dictated primarily by its mechanical properties.

In some applications, however, particular care must be taken not to scratch or otherwise mar the product surface. The guide surface materials for such applications must therefore be selected accordingly. This creates a problem because the mechanical properties of such guide surface materials may be totally inadequate with regard to resistance to centrifugal stresses. A basic object of the present invention is to provide a solution to this by providing a laying pipe having at least one outer tubular pipe section with entry and exit ends. The material for the tubular pipe section is selected primarily for its mechanical properties, in particular its ability to withstand centrifugal stresses. Liner members are inserted in the tubular pipe section to provide a guiding surface for a product length passing therethrough. The material for the liner members is selected with regard primarily to its ability to avoid scratching or otherwise marring the surface of the product. The liner members are replaceably contained within the outer pipe sections by retaining means located at the entry and exit ends thereof.

Preferably, the liner members are generally tubular in shape, each having an inwardly tapered nose at one end and an outwardly flared mouth at the opposite end. The liner members are arranged in end-to-end relationship in the tubular pipe sections, with the nose of one liner member seated in the mouth of the next successive liner member. The mouths of the liner members all face upstream with regard to the direction of movement of a product length passing through the laying pipe, and this arrangement provides a smooth substantially uninterrupted guiding surface spaced radially inwardly from the interior surface of the outer pipe sections.

Preferably, the aforesaid retaining means is comprised in part of a ring member fixed as by welding to the exit end of each outer pipe section. The ring member has an inner diameter which is smaller than that of the outer pipe section, with the tapered nose of the liner member at the exit end being seated in the ring member.

Preferably, where a plurality of outer tubular pipe sections are employed, the liner members at the entry ends of all but the first outer pipe section are provided with extended mouths protruding axially beyond said entry ends. The liner members at said entry ends are preferably further provided with at least one groove extending longitudinally for a limited distance along the outer surfaces thereof. The aforesaid retaining means at said entry ends may be comprised of removable locating pins protruding through the outer pipe section into said grooves. By simply removing the locating pins, worn liner members may be withdrawn axially from the outer pipe sections through their entry ends and thereafter replaced with new liner members, without having to also replace the outer pipe sections.

These and other objects, advantages and features of the present invention will become more apparent as the description proceeds with the aid of the accompanying drawings, wherein.

Figure 1:
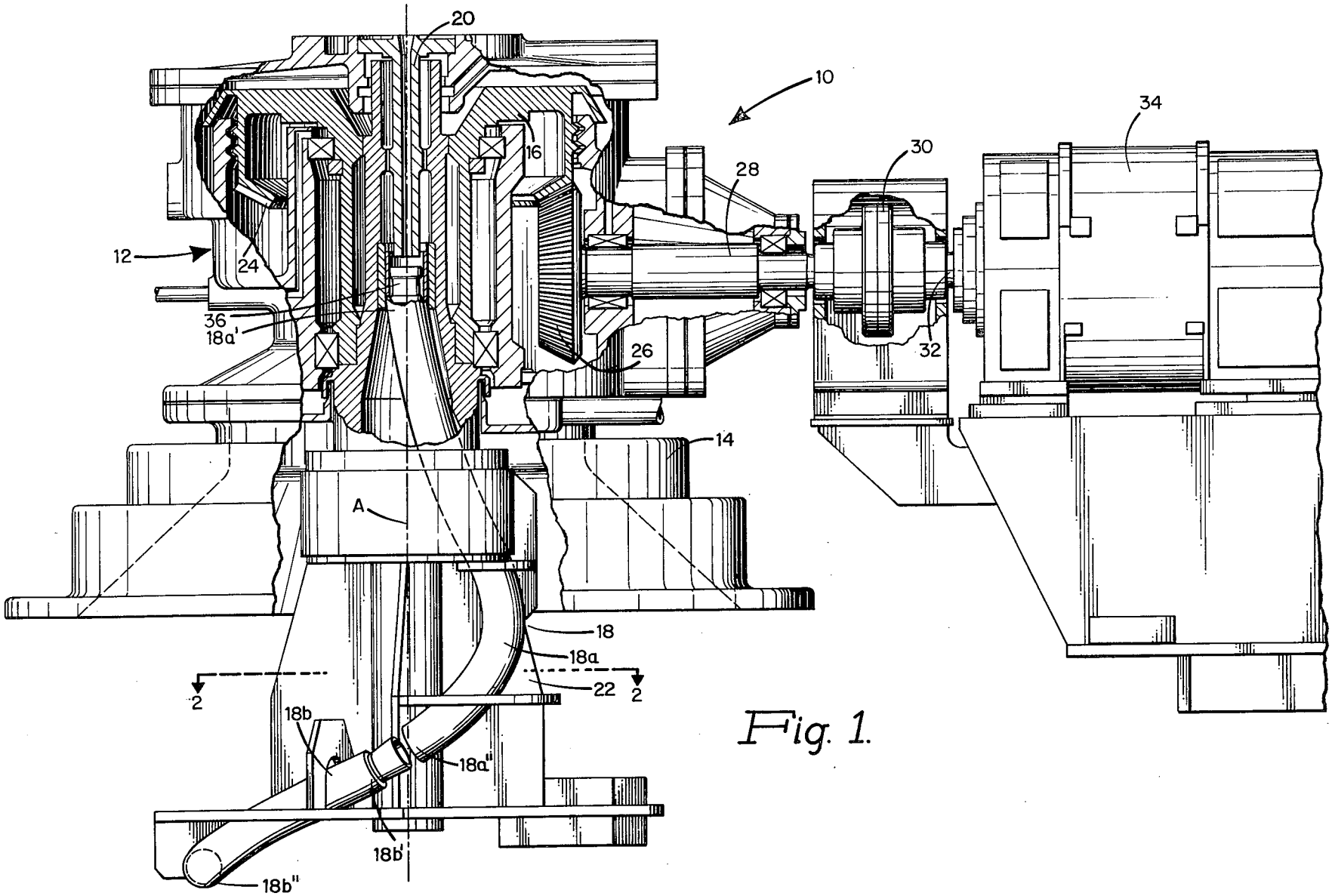
FIG. 1 is a side elevational view with portions broken away of a laying head employing a laying pipe embodying the concepts of the present invention.
Figure 2:
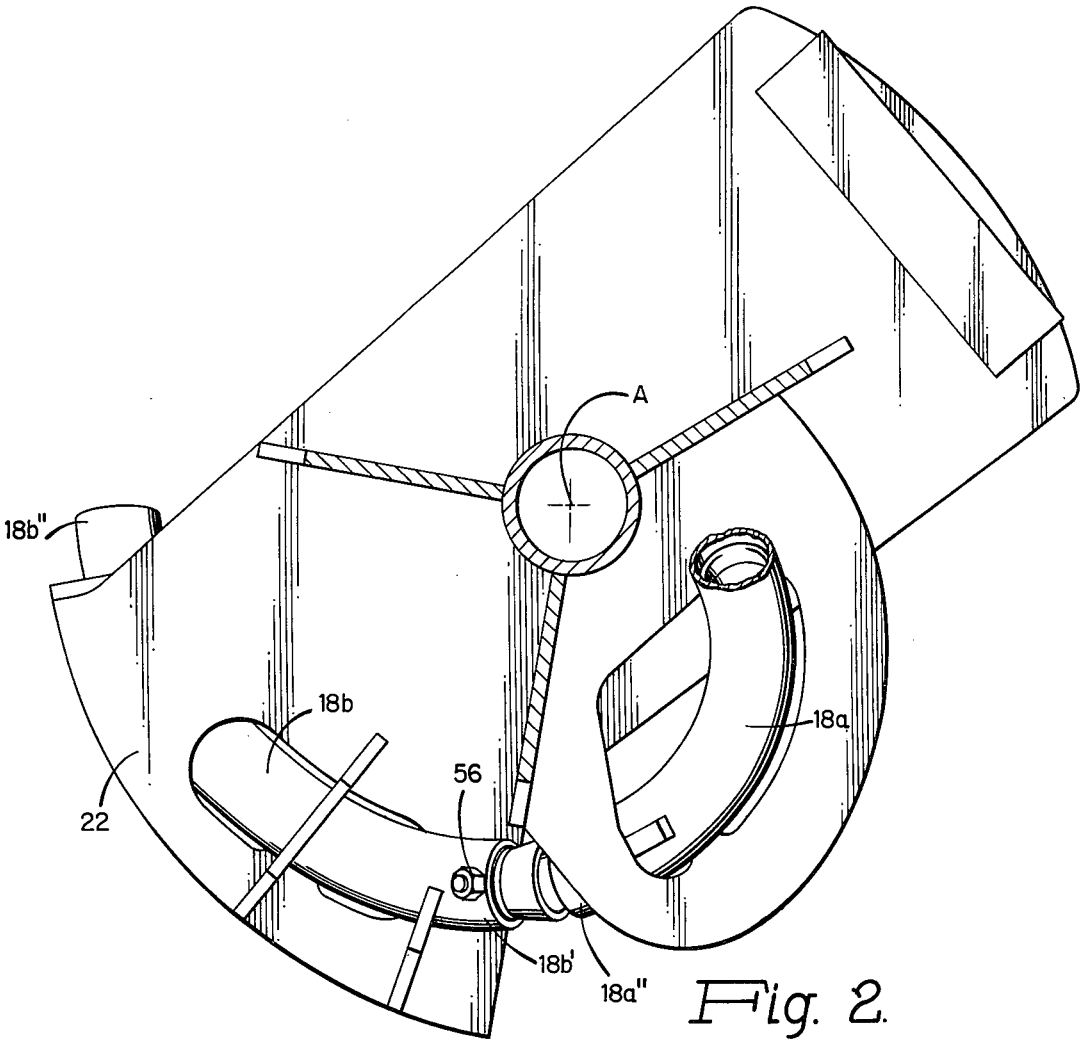
FIG. 2 is a sectional view taken along line 2—2 of FIG. 1.

Referring initially to FIG. 1, there is shown at 10 a laying head of generally conventional construction having a housing 12 with a depending stationary skirt 14. The housing contains a rotatable head 16 to which is attached a depending curved laying pipe generally indicated at 18. In the embodiment herein being employed for illustrative purposes, the pipe 18 is made up of cooperating curved upper and lower pipe sections **18*a*, 18*b*. It will be understood, however, that the number of pipe sections is not critical, as long as at least one is provided. The upper pipe section 18*a* has its entry end 18*a'* aligned with the rotational axis "A" of the head 16, and with an inlet guide 20** through which the product is received into the laying head from other guide apparatus (not shown).

The pipe sections **18*a*, 18*b* are suitably braced by a support structure generally indicated at 22 depending from the rotatable head 16. The head 16 has a bevel gear 24 which meshes with a bevel gear 26 carried on a drive shaft 28 connected by means of a coupling 30 to the output shaft 32 of a motor 34**.

The exit end **18*a''* of pipe section 18*a* is aligned with the entry end 18*b'* of the pipe section 18*b*, the latter terminating at an exit end 18*b''*. By operating motor 34 at an appropriate speed related to the delivery speed of product entering the laying head 10 through inlet guide 20, the product exiting from laying pipe 18 through exit end 18*b''*** will be formed into a helix prior to being deposited on an underlying support (not shown) which can comprise a collecting tub or a moving conveyor, depending on subsequent processing requirements.

The material for the curved pipe sections **18*a*, 18*b*** is selected primarily for its ability to withstand the centrifugal stresses developed during operation of the laying head. A typical example of one such material is stainless steel, although other like materials may also be employed. While materials of this type are sufficiently strong to withstand centrifugal stresses, their hardness is such that the product may be scratched or marred if it is allowed to come into frictional contact therewith.

Figure 4:
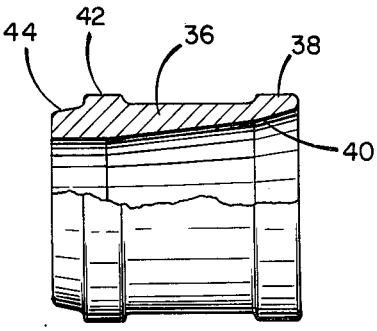
FIG. 4 is a side view on an enlarged scale with portions broken away of one of the tubular liner members; and, FIG. 5 is a side view with portions broken away of one of the liner members employed at the entry end of an outer tubular pipe section.
Figure 3:
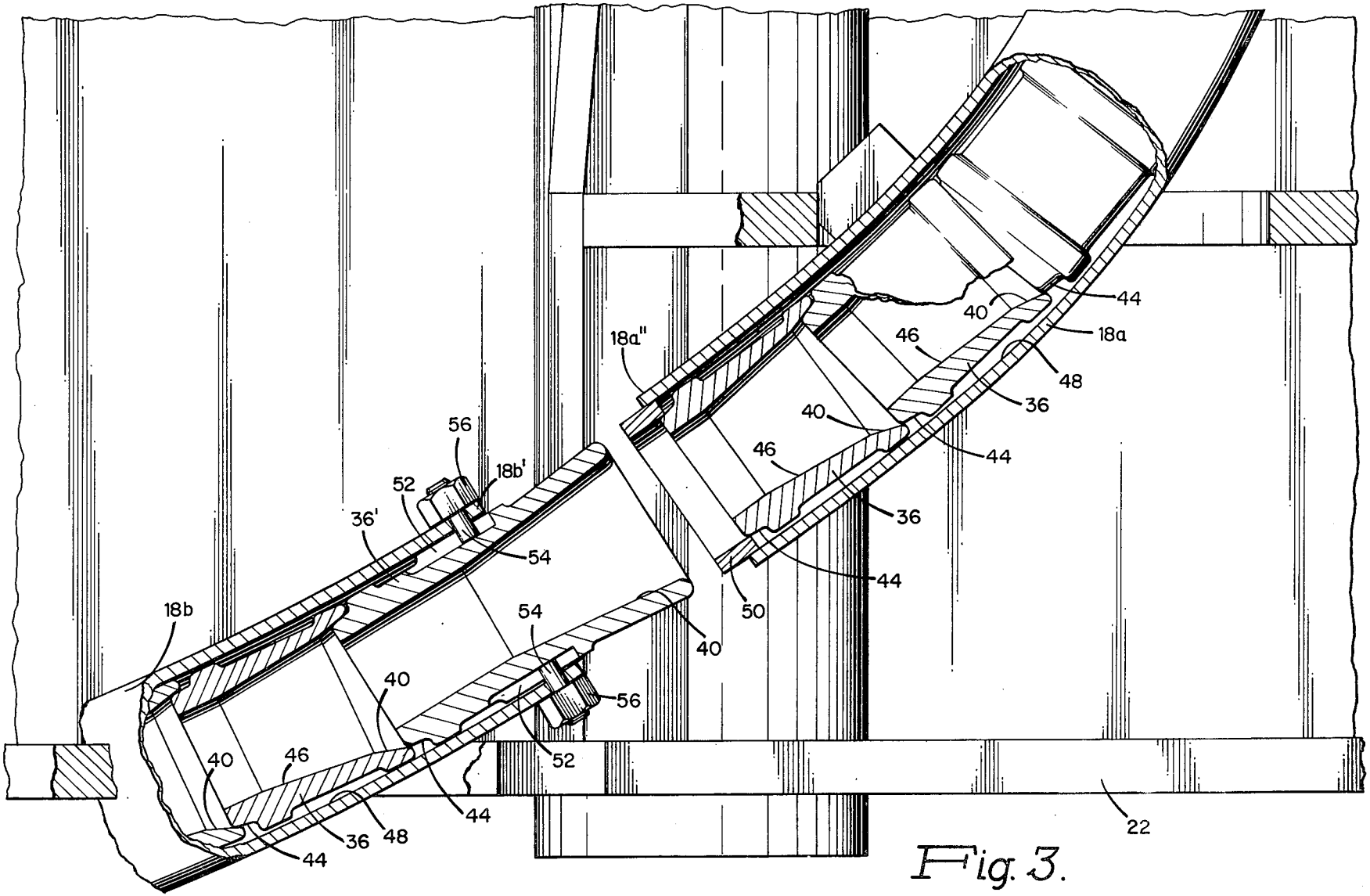
FIG. 3 is a side view of the laying pipe on an enlarged scale with portions broken away.

To avoid this problem, and as is best shown in FIG. 3, the present invention employs a plurality of liner members 36 inserted in end-to-end relationship in the pipe sections **18*a*, 18*b*. With reference to FIG. 4, it will be seen that each liner member 36 is generally tubular in construction, with a circular outer radial shoulder 38 surrounding an outwardly flared interior surface forming a mouth 40 at one end. Another radial shoulder 42 is located adjacent to an inwardly tapered nose 44 at the opposite end. As shown in FIG. 3, when the liner members 36 are arranged in end-to-end relationship in the outer pipe sections 18***a*, 18*b*, the nose 44 of one liner member is seated in the mouth 40 of the next successive liner member, with the mouths 40 of all of the liner members facing upstream with regard to the direction of movement of a product length through the laying pipe. The interior surfaces 46 of the liner members 36 thus cooperate in providing a guide surface which is spaced radially inwardly from the inner surfaces 48 of the pipe sections 18*a*, 18*b*.

Figure 5:
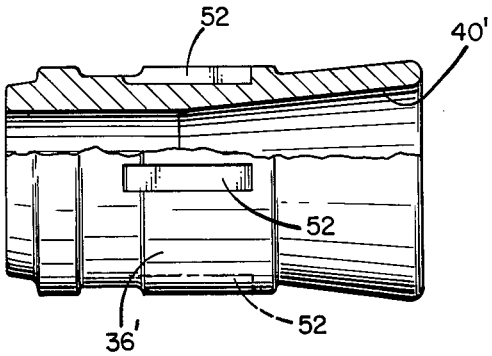

As shown in FIG. 5, the liner members 36' at the entry end 18*b'* of pipe section 18*b* is provided with an extended mouth 40'. Mouth 40' protrudes axially beyond the entry end 18*b'*.

The liner members are held in the pipe sections 18*a*, 18*b* by retaining means at the entry and exit ends thereof. The retaining means at each exit end comprises a ring member 50 (see FIG. 3) fixed to the exit end of the pipe section by any convenient means, for example by welding. The ring member 50 has an inner diameter which is smaller than the inner diameter of the pipe section to which it is fixed. The tapered nose 44 of the liner member 36 at the exit end is seated in and thus retained by the ring member 50.

At the entry end of the pipe section 18*b* the liner member 36' is provided with at least one and preferably a plurality of grooves 52 extending longitudinally for a limited distance along the outer surface thereof. The retaining means at the entry end 18*b'* of the pipe section 18*b* comprises locating pins 54 for each groove 52. The locating pins have threaded sections which are threaded through nuts 56 welded to the pipe section 18*b*. The nuts 56 overlie holes in the pipe section 18*b*, through which the pins 54 extend into the grooves 52 in the liner member 36'. The cooperative action of the ring member 50 acting on the liner member 36 at the exit end 18*b''*, and the pins 54 acting on the liner member 36' at the entry end 18*b'*, serves to axially retain the liner members in end-to-end relationship within the pipe section 18*b*. In order to replace the line members 36 in the upper pipe section 18*a*, it is first necessary to disengage the pipe section from the support 22 and the rotatable head 16.

The material for the liner members 36, 36' is selected primarily for its ability to provide a guide surface which will not scratch or otherwise mar the product passing through the laying pipe. An example of one such material might be centrifugally cast cast iron. When the liner members 36, 36' become worn, they can be replaced without having to also replace the outer pipe sections 18*a*, 18*b*.

It will thus be seen that the present invention incorporates a combination of ideal characteristics for a laying pipe, including high strength and resistance to centrifugal stresses (provided by the outer pipe sections 18*a*, 18*b*) and an ability to guide a product length without scratching or marring its surface (as a result of the material selected for the replaceable liner members 36, 36').

It is my intention to cover any changes or modifications to the disclosed embodiment which do not depart from the spirit and scope of the invention.

I claim:

1. In a rolling mill, a rotatable laying pipe for forming a longitudinally moving product length into a helix, comprising: at least one rigid curved tubular pipe section having entry and exit ends; liner means axially received in said pipe section for providing a guiding surface for a product length passing through the laying pipe, the said guiding surface being spaced radially inwardly from the inner surface of said pipe section; and, retaining means at the entry and exit ends of said pipe section for axially retaining said liner means in said pipe section.

2. The laying pipe as claimed in claim 1 wherein said liner means is comprised of a plurality of tubular members, each having an inwardly tapered nose at one end and an outwardly flared mouth at the opposite end, the said tubular members being arranged in end-to-end relationship in said pipe section with the nose of one member seated in the mouth of the next successive member, and with the mouths of said members facing upstream with regard to the direction of movement of a product length through said laying pipe.

3. The laying pipe as claimed in claim 2 wherein said retaining means is comprised in part of a ring member fixed to the exit end of said pipe section, said ring member having an inner diameter smaller than the inner diameter of said pipe section, with the tapered nose of the tubular member at said exit end being axially received by and fixedly seated in said ring member.

4. The laying pipe as claimed in claim 3 wherein the tubular member at the entry end of said pipe section is provided with an extended mouth protruding axially beyond said entry end.

5. The laying pipe as claimed in claim 4 wherein the tubular member at the entry end of said pipe section is provided with at least one groove extending longitudinally for a limited distance along the outer surface thereof, said retaining means being further comprised of a removable locating pin protruding through said pipe section into said groove.

* * * * *